US010794348B2

(12) United States Patent
Saito et al.

(10) Patent No.: US 10,794,348 B2
(45) Date of Patent: Oct. 6, 2020

(54) FUEL INJECTION VALVE

(71) Applicant: Hitachi Automotive Systems, Ltd., Hitachinaka-shi, Ibaraki (JP)

(72) Inventors: Takahiro Saito, Isesaki (JP); Ryuta Kinoshita, Mito (JP); Nobuaki Kobayashi, Maebashi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 2 days.

(21) Appl. No.: 16/333,522

(22) PCT Filed: Aug. 9, 2017

(86) PCT No.: PCT/JP2017/028878
§ 371 (c)(1),
(2) Date: Mar. 14, 2019

(87) PCT Pub. No.: WO2018/066226
PCT Pub. Date: Apr. 12, 2018

(65) Prior Publication Data

US 2019/0257277 A1 Aug. 22, 2019

(30) Foreign Application Priority Data

Oct. 6, 2016 (JP) ..... 2016-197854

(51) Int. Cl.
*F02M 61/04* (2006.01)
*B05B 1/30* (2006.01)
(Continued)

(52) U.S. Cl.
CPC ..... *F02M 61/04* (2013.01); *B05B 1/3053* (2013.01); *F02M 51/06* (2013.01); *F02M 61/168* (2013.01); *F02M 61/18* (2013.01)

(58) Field of Classification Search
CPC ..... F02M 61/04; F02M 51/06; F02M 61/18; F02M 61/168; B05B 1/3053
(Continued)

(56) References Cited

U.S. PATENT DOCUMENTS 4,648,559 A * 3/1987 Fuller ..... F02M 51/0632 239/900
6,814,312 B2 * 11/2004 Iwano ..... F02M 51/0682 239/533.12
(Continued)

FOREIGN PATENT DOCUMENTS

JP 2002-266721 A 9/2002
JP 2002-303222 A 10/2002
(Continued)

OTHER PUBLICATIONS

International Search Report (PCT/ISA/210) issued in PCT Application No. PCT/JP2017/028878 dated Oct. 17, 2017 with English translation (four (4) pages).
(Continued)

*Primary Examiner* — Steven J Ganey
(74) *Attorney, Agent, or Firm* — Crowell & Moring LLP

(57) ABSTRACT

A fuel injection valve includes: a valve seat member to which the valve seat is formed; a welding portion between the valve seat member and the cylindrical member, which is provided on the base end side of the stepped surface, the valve seat member being assembled to be press-fit in the cylindrical member so that a tip end side abutment pressure
(Continued)

between an inner circumference surface of the cylindrical member, and a tip end side outer circumference surface portion of the valve seat member which is on the tip end side of the stepped surface is smaller than a base end side abutment pressure between the inner circumference surface of the cylindrical member, and a base end side outer circumference surface portion of the valve seat member which is on the base end side of the stepped surface portion.

7 Claims, 7 Drawing Sheets

(51) Int. Cl.
*F02M 51/06* (2006.01)
*F02M 61/18* (2006.01)
*F02M 61/16* (2006.01)

(58) Field of Classification Search
USPC ..... 239/533.12, 585.1, 585.4, 585.5, 900, 239/600; 251/129.15; 29/890.12, 29/890.122
See application file for complete search history.

(56) References Cited

U.S. PATENT DOCUMENTS

| | | | | |
|---|---|---|---|---|
| 7,314,184 | B2 * | 1/2008 | Hornby | F02M 51/005 239/533.12 |
| 7,370,816 | B2 * | 5/2008 | Kumagai | F02M 61/1853 239/585.1 |
| 2002/0124405 | A1 | 9/2002 | Hasegawa et al. | |
| 2002/0139873 | A1 | 10/2002 | Ito et al. | |
| 2014/0367498 | A1 | 12/2014 | Takaoku et al. | |

FOREIGN PATENT DOCUMENTS

| | | | |
|---|---|---|---|
| JP | 2013-164027 | A | 8/2013 |
| JP | 2013-181409 | A | 9/2013 |

OTHER PUBLICATIONS

Japanese-language Written Opinion (PCT/ISA/237) issued in PCT Application No. PCT/JP2017/028878 dated Oct. 17, 2017 (three (3) pages).

* cited by examiner

FUEL INJECTION VALVE

TECHNICAL FIELD

This invention relates to a fuel injection valve arranged to inject a fuel.

BACKGROUND ART

There is known a fuel injection valve described in Japanese Patent Application Publication No. 2002-303222 (Patent Document 1), as a background art of this technical field. This fuel injection valve includes a housing pipe; a valve element arranged to be reciprocated within the housing pipe in an axial direction; and a body valve including a bottom wall having a valve seat on which the valve element is seated, and a side wall which extends upwardly from a circumferential periphery of the bottom wall, and which includes a heat joint portion formed between the housing pipe and the side wall. Before the housing pipe and the valve body are jointed, there is previously provided a heat deformation absorbing space positioned between the heat joint portion and the valve seat, and arranged to absorb heat deformation by joint (welding) heat (cf. Abstract). The fuel injection valve of the patent document 1 attains effects to provide the fuel injection valve including the valve seat devised to decrease the distortion due to the joint heat, and to have good accuracy of the size (paragraph 0041). Moreover, this fuel injection valve is arranged to vary the shape of the heat deformation absorbing space (the annular groove) when the valve body is press-fit in the inner circumference side of the housing pipe, and thereby to absorb the distortion generated in the body valve at the press-fit. With this, it is possible to attain the effects to suppress the decrease of the size accuracy of the valve seat due to the press-fit (cf. paragraph 0017).

PRIOR ART DOCUMENT

Patent Document

Patent Document 1: Japanese Patent Application Publication No. 2002-303222

SUMMARY OF THE INVENTION

In the fuel injection valve of the patent document 1, it is possible to absorb the distortion generated at the press-fit and the welding, by the heat deformation absorbing space, and to suppress the decrease of the roundness and the size accuracy of the valve seat.

However, in the side wall extending upwardly from the circumferential periphery of the bottom wall of the body valve in the fuel injection valve of the patent document 1, a side wall portion (hereinafter, referred to as an upper side wall portion) above the heat deformation absorbing space constituted by the annular groove is press-fit in the inner circumference side of the housing pipe. A side wall portion (hereinafter, referred to as a lower side wall portion) below the heat deformation absorbing space is positioned outside the housing pipe. In this case, when the distortion is generated in the body valve at the portion of the heat deformation absorbing space, a central axis of the upper side wall portion of the body valve which is press-fit in the inner circumference side of the housing pipe is misaligned with a central axis of the lower side wall portion in which the bottom wall having the valve seat is constituted, so that a concentricity between the upper side portion and the lower side portion of the body valve may be deteriorated. In the fuel injection valve of the patent document 1, this deterioration of the concentricity is not considered.

The above-described decreases of the concentricity, the roundness, and the size accuracy of the valve seat cause the deterioration of the oil tightness of the seal portion at which the valve element and the valve seat are abutted on each other.

The housing pipe and the valve body of the patent document 1 correspond to a cylindrical member and a valve seat member in the present invention. In below-described explanations, they are referred to as the cylindrical member and the valve seat member.

It is, therefore, an object of the present invention to provide a fuel injection valve devised to suppress a deterioration of an oil tightness of a seal portion at which a valve element and a valve seat are abutted on each other.

For attaining the above-described object, a fuel injection valve according to the present invention comprises:

a valve element and a valve seat which are cooperated to open and close a fuel passage;

a valve seat member to which the valve seat is formed;

a cylindrical member including an end portion which is on a tip end side, and to which the valve seat member is assembled by press-fit and welding; and the valve seat member including a side wall portion which is formed on an outer circumference side of the valve seat, and which extends toward a base end side, the side wall portion including a stepped surface positioned between an end portion on the tip end side, and an end portion on the base end side, a welding portion between the valve seat member and the cylindrical member, which is provided on the base end side of the stepped surface, the valve seat member being assembled to be press-fit in the cylindrical member so that a tip end side abutment pressure between an inner circumference surface of the cylindrical member, and a tip end side outer circumference surface portion of the valve seat member which is on the tip end side of the stepped surface is smaller than a base end side abutment pressure between the inner circumference surface of the cylindrical member, and a base end side outer circumference surface portion of the valve seat member which is on the base end side of the stepped surface portion.

By the present invention, it is possible to suppress the deterioration of the concentricity of the valve seat, and to suppress the deterioration of the oil tightness of the seal portion at which the valve element and the valve seat are abutted on each other.

Other effects according to the present invention are explained in explanations of embodiments.

DESCRIPTION OF EMBODIMENTS

One embodiment according to the present invention are explained with reference to FIG. 1 to FIG. 3.

An overall configuration of a fuel injection valve 1 is explained with reference to FIG. 1. FIG. 1 is a sectional view showing a section along a valve axis (a central axis), in the fuel injection valve according to an embodiment of the present invention. The center axis 1*x* corresponds to an axis (valve axis) 27*x* of a movable member 27 in which a valve element 27*c*, a rod portion (connection portion) 27*b*, and a movable iron core 27*a*A are integrally provided. Moreover, the central axis 1*x* corresponds to central axes of a cylindrical member 5 and a valve seat member 15.

Figure 1:
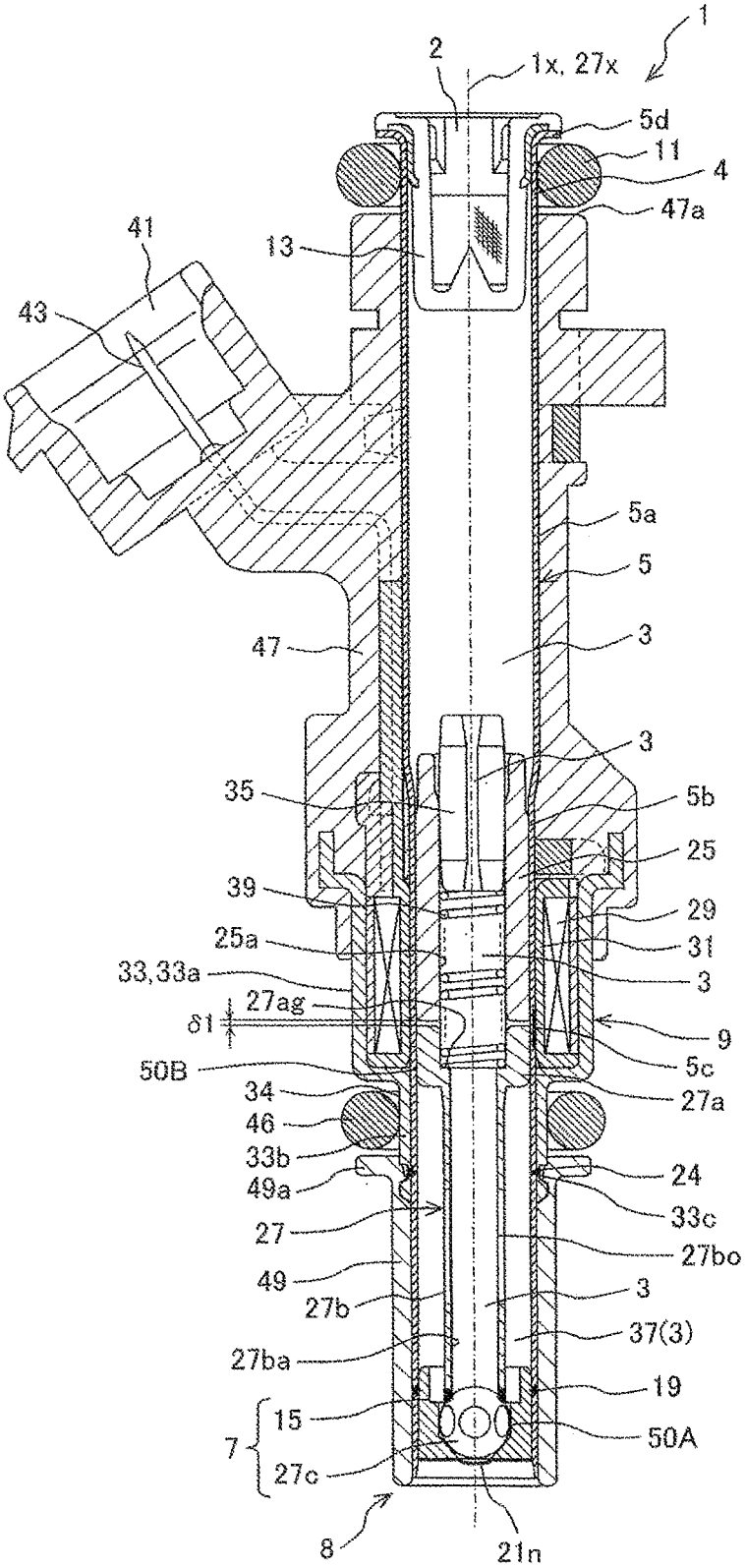
FIG. 1 is a sectional view showing a section along a valve axis (central axis) of a fuel injection valve according to the present invention.
Figure 2:
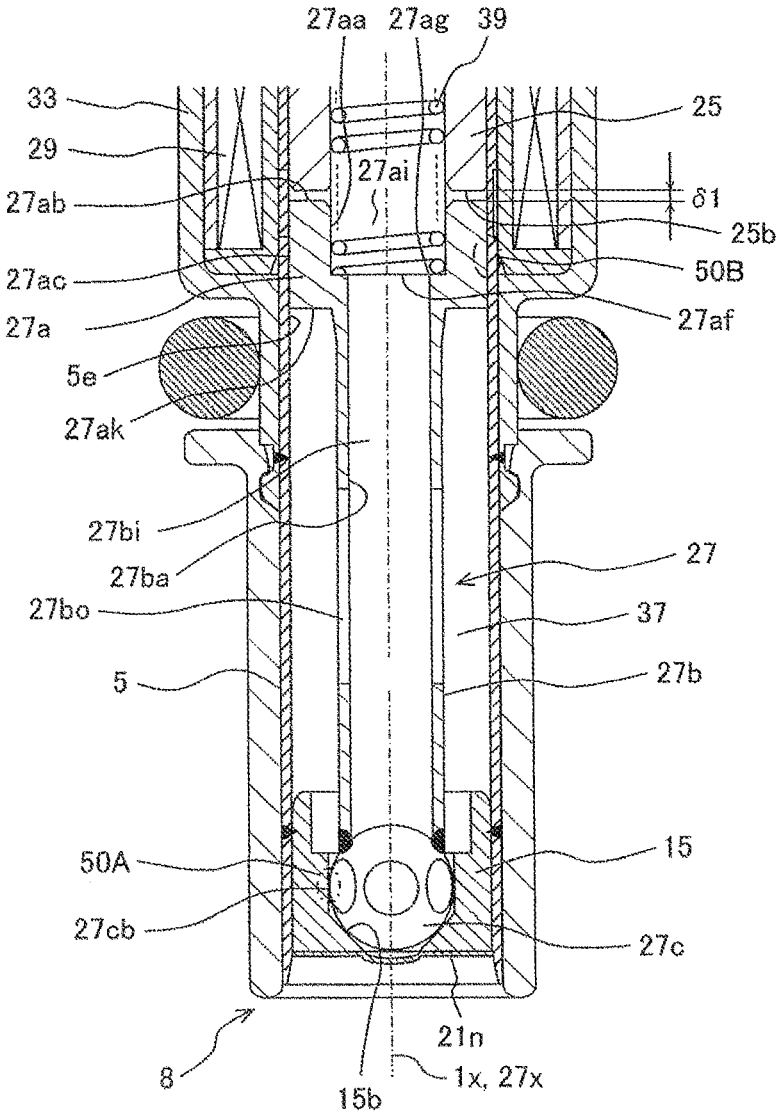
FIG. 2 is an enlarged sectional view showing a portion near a movable member 27 shown in FIG. 1.

In FIG. 1, an upper end portion (upper end side) of the fuel injection valve 1 may be referred to as a base end portion (base end side). A lower end portion (lower end side) of the fuel injection valve 1 may be referred to as a tip end portion (tip end side). The way of calling the base end portion (the base end side) and the tip end portion (the tip end side) are based on a flow direction of the fuel, or a mounting structure of the fuel injection valve 1 with respect to fuel pipes. Moreover, the upward and downward directions in the specification are based on FIG. 1. The upward and downward directions in the specification do not relate to upward and downward directions when the fuel injection valve 1 is mounted to an internal combustion engine.

Fuel injection valve 1 includes a cylindrical member 5 made from the metal; and a fuel flow passage (fuel passage) 3 which is formed in the cylindrical member 5, and which extends substantially along the central axis 1*a*. The cylindrical member 5 is made from metal material such as a stainless having magnetism. The cylindrical member 5 has a stepped shape along the central axis 1*a* by the press processing such as the deep drawing. With this, the cylindrical member 5 includes a first end portion (a large diameter portion 5*a* side) having a diameter larger than a diameter of a second end portion (a small diameter portion 5*b* side).

A fuel supply opening 2 is provided to the base end portion of the cylindrical member 5. At this fuel supply opening 2, there is provided a fuel filter 13 arranged to remove foreign particle mixed in the fuel.

The base end portion of the cylindrical member 5 includes a flange portion (large diameter portion) 5*d* which is bent in the radially outward direction to increase the diameter. An O-ring 11 is disposed in an annular recessed portion (annular groove portion) 4 formed by the flange portion 5*d* and a base end side end portion 47*a* of a resin cover 47.

The tip end portion of the cylindrical member 5 includes a valve section 7 constituted by a valve element 27*c* and a valve seat member 15. The valve seat member 15 is inserted into the inside of the tip end side of the cylindrical member 5. The valve seat member 15 is fixed to the cylindrical member 5 by the laser welding. The laser welding is performed to an overall circumference of the cylindrical member 5 from the outer circumference side of the cylindrical member 5. In this case, the valve seat member 15 is press-fit into the inside of the tip end side of the cylindrical member 5. Then, the valve seat member 15 is fixed to the cylindrical member 5 by the laser welding.

A nozzle plate 21*n* is fixed to the valve seat member 15 to constitute a nozzle section 8 of the valve seat member 15 and the nozzle plate 21*n*. The valve seat member 15 is inserted and fixed into the inner circumference surface of the cylindrical member 5, so that the valve seat member 15 and the nozzle plate 21*n* are assembled to the tip end side of the cylindrical member 5.

The cylindrical member 5 according to this embodiment is constituted by one member from a portion to which the fuel supply opening 2 is provided, to a portion to which the valve seat member 15 and the nozzle plate 21*n* are fixed. However, a portion (the base end side portion) to which the fuel supply opening 2 is provided, and a portion (the tip end side portion) to which the valve seat member 15 and the nozzle plate 21*n* are provided may be constituted by different members to constitute the cylindrical member 5. The tip end side portion of the cylindrical member 5 constitutes a nozzle holder arranged to hold the nozzle section 8. In this embodiment, the nozzle holder is constituted by the one member with the base end side portion of the cylindrical member 5.

A drive section 9 is disposed at an intermediate portion of the cylindrical member 5. The drive portion 9 is arranged to drive the valve element 27*c*. The drive portion 9 is constituted by an electromagnetic actuator (electromagnetic drive section). In particular, the drive portion 9 includes a fixed iron core 25 fixed in the inside (on the inner circumference side) of the cylindrical member 5; a movable member 27 which is disposed within the cylindrical member 5, on the tip end side of the fixed iron core 25, and which is arranged to be moved in a direction along the central axis 1*a*; an electromagnetic coil 29 mounted on an outer circumference side of the cylindrical member 5 at a position at which the fixed iron core 25 and the movable iron core 27*a* constituted in the movable member 27 confront each other through a minute gap δ1; and a yoke 33 which covers the electromagnetic coil 29 on the outer circumference side of the electromagnetic coil 29.

The movable member 27 is received within the cylindrical member 5. The cylindrical member 5 confronts the outer circumference surface of the movable iron core 27*a* to constitute a housing surrounding the movable iron core 27*a*.

The movable iron core 27*a*, the fixed iron core 25, and the yoke 33 constitute a closed magnetic path in which the magnetic flux generated by energizing the electromagnetic coil 29 flows. Although the magnetic flux passes through the minute gap δ1, a nonmagnetic portion or a weak (feeble) magnetic portion having magnetism weaker than that of other portions of the cylindrical member 5 is provided at a position corresponding to the minute gap δ1 of the cylindrical member 5 so as to decrease the magnetic flux leakage flowing in the cylindrical member 5 at the minute gap δ1. Hereinafter, this nonmagnetic portion or the weak magnetic portion is referred to merely as nonmagnetic portion 5*c*. This nonmagnetic portion 5*c* can be formed by nonmagnetizing (demagnetizing) the cylindrical member 5 having the magnetism. This nonmagnetization can be performed by the heat treatment. Alternatively, this nonmagnetic portion 5*c* can be constituted by an annular recessed portion formed on the outer circumference surface of the cylindrical member 5, so as to decrease a thickness of the portion corresponding to the nonmagnetic portion 5*c*.

The electromagnetic coil 29 is wound around a bobbin 31 made from resin material into a cylindrical shape. The electromagnetic coil 29 is mounted on the outer circumference side of the cylindrical member 5. The electromagnetic coil 29 is electrically connected to a terminal 43 provided to a connector 41. The connector 41 is connected to an outer drive circuit (not shown) to apply the drive current to the electromagnetic coil 29 through the terminal 43.

The fixed iron core 25 is made from the magnetic metal material. The fixed iron core 25 is formed into a cylindrical shape. The fixed iron core 25 includes a through hole 25*a* which penetrates through the central portion of the fixed iron core 25 in a direction along the central axis 1*x*. The through hole 25*a* constitutes a fuel passage (upstream side fuel passage) 3 on the upstream side of the movable iron core 27*a*. The fixed iron core 25 is fixed on the base end portion of the small diameter portion 5*b* of the cylindrical member 5 by the press-fit. The fixed iron core 25 is positioned at an intermediate portion of the cylindrical member 5. The large diameter portion 5*a* is provided on the base end side of the small diameter portion 5*b*. With this, it is possible to ease the assembly operation of the fixed iron core 25. The fixed iron core 25 may be fixed to the cylindrical member 5 by the welding. Moreover, the fixed iron core 25 may be fixed to the cylindrical member 5 by using both the welding and the press-fit.

The movable member 27 is constituted by the movable iron core 27*a*, the rod portion (connection portion) 27*b*, and the valve element 27*c*. The movable iron core 27*a* is an annular member. The valve element 27*c* is a member arranged to be abutted on a valve seat 15*b* (cf. FIG. 3). The valve element 27*c* is arranged to open and close the fuel passage in cooperation with the valve seat 15*b*. The rod portion 27*b* has a long and narrow cylindrical shape. The rod portion 27*b* is a connection portion connecting the movable iron core 27*a* and the valve element 27*c*.

The movable iron core 27*a* is connected to the valve element 27*c*. The movable iron core 27*a* is arranged to drive the valve element 27*c* in the valve opening direction or the valve closing direction by the magnetic attraction force acted between the fixed iron core 25 and the movable iron core 27*a*.

In this embodiment, the movable iron core 27*a* is fixed to the rod portion 27*b*. However, the movable iron core 27*a* may be connected to the rod portion 27*b* so as to be moved relative to the rod portion 27*b*.

In this embodiment, the rod portion 27*b* and the valve element 27*c* are constituted by different members. The valve element 27*c* is fixed to the rod portion 27*b*. The rod portion 27*b* and the valve element 27*c* are fixed by the press-fit or the welding. The rod portion 27*b* and the valve element 27*c* may be integrally constituted by one member.

The rod portion 27*b* has a cylindrical shape. The rod portion 27*b* includes a hole 27*ba* which includes an upper end opened to the lower end portion of the movable iron core 27*a*, and which extends in the axial direction. The rod portion 27*b* includes a connection hole (opening portion) 27*bo* connecting the inside (the inner circumference side) and the outside (the outer circumference side). A fuel chamber 37 is formed between the outer circumference surface of the rod portion 27*b* and the inner circumference surface of the cylindrical member 5.

A coil spring 39 is provided in the through hole 25*a* of the fixed iron core 25. One end of the coil spring 39 is abutted on a spring seat 27*ag* provided inside the movable iron core 27*a*. The other end of the coil spring 39 is abutted on an adjuster (adjusting member) disposed within the through hole 25*a* of the fixed iron core 25. The coil spring 39 is disposed in a compressed state between the spring seat 27*ag* provided to the movable iron core 27*a*, and a lower end (tip end side end surface) of the adjuster (adjusting member) 35.

The coil spring 39 is an urging member arranged to urge the movable member 27 in a direction (the valve closing direction) in which the valve element 27*c* is abutted on the valve seat 15*b*. The urging force of the movable member 27 (that is, the valve element 27*c*) by the coil spring 39 is adjusted by adjusting the position of the adjuster 35 within the through hole 25*a* in the direction along the central axial 1*x*.

The adjuster 35 includes the fuel flow passage 3 which penetrates through the central portion of the adjuster 35 in the direction along the central axis 1*x*.

The fuel supplied from the fuel supply opening 2 flows in the fuel flow passage 3 of the adjuster 35. Then, the fuel flows in the fuel flow passage 3 of the tip end side portion of the through hole 25*a* of the fixed iron core 25, and flows in the fuel flow passage 3 constituted within the movable member 27.

The yoke 33 is made from the metal material having the magnetism. The yoke 33 also serves as the housing of the fuel injection valve 1. The yoke 33 is formed into a stepped cylindrical shape having a large diameter portion 33*a* and a small diameter portion 33*b*. The large diameter portion 33*a* has a cylindrical shape covering the outer circumference of the electromagnetic coil 29. The small diameter portion 33*b* having the diameter smaller than the diameter of the large diameter portion 33*a*. The small diameter portion 33*b* is formed on the tip end side of the large diameter portion 33*a*. The small diameter portion 33*b* is press-fit or mounted on the outer circumference of the small diameter portion 5*b* of the cylindrical member 5. With this, the inner circumference surface of the small diameter portion 33*b* is closely (tightly) contacted on the outer circumference surface of the cylindrical member 5. In this case, at least a part of the inner circumference surface of the small diameter portion 33*b* confronts the outer circumference surface of the movable iron core 27*a* through the cylindrical member 5, so as to decrease the magnetic resistance in the magnetic path formed at these confronting portions.

The yoke 33 includes an annular recessed portion 33*c* which is formed in the circumferential direction on the outer circumference surface of the tip end side end portion. A small thickness portion is formed on a bottom surface of the annular recessed portion 33*c*. At this small thickness portion of the annular recessed portion 33*c*, the yoke 33 and the cylindrical member 5 are jointed in the entire circumference by the laser welding.

A cylindrical protector 49 having a flange portion 49*a* is mounted on the tip end portion of the cylindrical member 5. The tip end portion of the cylindrical member 5 is protected by the protector 49. The protector 49 covers the laser welding portion 24 of the yoke 33.

The flange portion 49*a* of the protector 49, the small diameter portion 33*b* of the yoke 33, the stepped surface between the large diameter portion 33*a* and the small diameter portion 33*b* of the yoke 33 constitute an annular groove 34. An O-ring 46 is mounted on the annular groove 34. The O-ring 46 serves as a seal arranged to secure the liquid tightness and the air tightness between an inner circumference surface of an insertion opening formed in the internal combustion engine, and the outer circumference surface of the small diameter portion 33*b* of the yoke 33 when the fuel injection valve 1 is mounted to the internal combustion engine.

The resin cover 47 is molded from the intermediate portion of the fuel injection valve 1 to a portion near the base end side end portion of the fuel injection valve 1. The tip end side end portion of the resin cover 47 covers a part of the base end side of the large diameter portion 33*a* of the yoke 33. Moreover, the connector 41 is integrally formed by the resin forming the resin cover 47.

A configuration near the movable member 27 is explained in detail with reference to FIG. 2. FIG. 2 is an enlarged sectional view showing the configuration near the movable member 27 shown in FIG. 1.

In the embodiment, the movable iron core 27*a* and the rod portion 27*b* are integrally formed by one member.

The movable iron core 27*a* includes a recessed portion 27*aa* which is formed at a central portion of an upper end surface (upper end portion) 27*ab*, and which is recessed toward the lower end side. The spring seat 27*ag* is formed on a bottom portion of the recessed portion 27*aa*. One end of the coil spring 39 is supported by the spring seat 27*ag*. Moreover, an opening portion 27*af* is formed on the spring seat 27*ag* of the recessed portion 27*aa*. The opening portion 27*af* is connected to the inside of the hole 27*ba* of the rod portion 27*b*. The opening portion 27*af* constitutes a fuel passage arranged to flow the fuel flowing from the through hole 25*a* of the fixed iron core 25 into a space 27*ai* within the recessed portion 27*aa*, to a space 27*bi* inside the hole 27*ba* of the rod portion 27*b*.

In this embodiment, the rod portion 27*b* and the movable iron core 27*a* are constituted by one member. However, the rod portion 27*b* and the movable iron core 27*a* may be constituted by integrally assembling different members.

The upper end surface 27*ab* of the movable iron core 27*a* is an end surface which is positioned on the side of the fixed iron core 25, and which confronts the lower end surface 25*b* of the fixed iron core 25. The end surface of the movable iron core 27*a* which is opposite to the upper end surface 27*ab* is an end surface which is positioned on the tip end side (the nozzle side) of the fuel injection valve 1, and which is referred to as a lower end surface (lower end portion) 27*ak* hereinafter.

The upper end surface 27*ab*, and the lower end surface 25*b* of the fixed iron core 25 constitute magnetic attraction surfaces to which the magnetic attraction forces are acted to each other.

In this embodiment, a sliding portion is constituted on the outer circumference surface 27*ac* of the movable iron core 27*a*. The sliding portion is arranged to be slidably moved on the inner circumference surface 5*e* of the cylindrical member 5. This sliding portion includes raised portions (not shown) which are formed on the outer circumference surface 27*ac*, and which protrude in the radially outward directions. The inner circumference surface 5*e* is an upstream guide surface on which the outer circumference surface 27*ac* of the movable iron core 27*a* is slidably abutted. The inner circumference surface 5*e*, and the outer circumference surface 27*ac* of the movable iron core 27*a* (precisely, the raised portions formed on the outer circumference surface 27*ac*) constitute an upstream guide portion 50B arranged to guide the displacement of the movable member 27.

On the other hand, a downstream guide portion 50A (described in detail later) is constituted between the valve element 27*c* and the valve seat member 15. The movable member 27 is arranged to be guided by two points of the upstream guide portion 50B and the downstream guide portion 50A, and to be reciprocated in the direction along the central axis 1*x* (in the valve opening and closing directions).

The rod portion 27*b* includes an opening portion (connection hole) 27*bo* connecting the inside (the hole 27*ba*) and the outside (the fuel chamber 37). The connection hole 27*bo* is disposed at a central portion in the axial direction (the direction of the center axis 1*x*) of the rod 27*b*. The connection hole 27*bo* constitutes a fuel passage connecting the inside and the outside of the rod portion 27*b*. With this, the fuel within the through hole 25*a* of the fixed iron core 25 flows through the hole 27*ba* and the connection hole 27*bo* to the fuel chamber 37.

Next, a configuration of the nozzle section 8 is explained in detail with reference to FIG. 3. FIG. 3 is an enlarged sectional view showing a portion near the nozzle section 8 shown in FIG. 2.

The valve seat member 15 includes through holes 15*d*, 15*c*, 15*v*, and 15*e* which are formed to penetrate through the valve seat member 15 in the direction along the central axis 1*x*. A conical surface (through hole 15*v*) is formed in the middle of this through hole. This conical surface has diameters decreased toward the downstream side. The valve seat 15*b* is constituted on the conical surface. The valve element 27*c* is arranged to be abutted on and separated from the valve seat 15*b*, and thereby to open and close the fuel passage. Besides, the conical surface on which the valve seat 15*b* is formed may be referred to as a valve seat surface.

Besides, the valve seat 15*b* may be referred to as a seat portion. The valve seat 15*b*, and the portion of the valve element 27*c* which is abutted on the valve seat 15*b* may be referred to as the seat portion. The valve seat 15*b* constitutes the seat portion of the valve seat member 15. The portion of the valve element 27*c* which is abutted on the valve seat 15*b* constitutes the seat portion of the valve element 27*c*. Moreover, abutment portions of the valve seat 15*b* and the valve element 27*c* which are abutted on each other constitute seal portions arranged to seal the fuel in the valve closing state.

In the through holes 15*d*, 15*c*, 15*v*, and 15*e*, hole portions (the through holes 15*d*, 15*c*, and 15*v*) on the upper side of the conical surface (through holes 15*v*) constitute a valve element receiving hole receiving the valve element 27*c*. A guide surface is formed on the inner circumference surfaces of the through holes 15*d*, 15*c*, and 15*v*. The guide surface is arranged to guide the valve element 27*c* in the direction along the central axis 1*x*. The guide surface constitutes the downstream side guide surface in the two guide surfaces arranged to guide the movable member 27.

The downstream guide surface, and the slidably abutment surface (sliding surface) 27*cb* of the valve element 27*c* which is slidably abutted on this downstream side guide surface constitute the downstream side guide portion 50A arranged to guide the displacement of the movable member 27.

The large diameter portion (through hole 15*d*) is formed on the upstream side of the guide surface. The large diameter portion has an inside diameter (diameter) larger than an inside diameter (diameter) of the hole constituting the guide surface. The large diameter portion constitutes (includes) a small thickness portion 80 which is provided to a side wall portion 15*w* of the valve seat member 15, and which has a small thickness. The small thickness portion 80 is explained in detail later.

Lower end portions of the through holes 15*d*, 15*c*, and 15*v* are connected to the through hole 15*e* which is the fuel introduction hole. The lower end surface of the through hole 15*e* is opened to the tip end surface 15*t* of the valve seat member 15.

The nozzle plate 21*n* is mounted to the tip end surface 15*t* of the valve seat member 15. The nozzle plate 21*n* is fixed to the valve seat member 15 by the laser welding. The laser welding portion 23 makes a circle of the injection hole forming region in which the fuel injection hole 110 is formed, so as to surround the injection hole forming region.

Moreover, the nozzle plate 21*n* is constituted by a plate member (flat plate) having a uniform thickness. The nozzle plate 21*n* includes a protruding portion 21*na* which is formed at a central portion of the nozzle plate 21*n*, and which protrudes outwardly. The protruding portion 21*na* is formed by a curved surface (for example, spherical surface). A fuel chamber 21*a* is formed within the protruding portion 21*na*. This fuel chamber 21*a* is connected to the through hole 15*e* formed in the valve seat member 15. The fuel is supplied through the through hole 15*e* to the fuel chamber 21*a*.

The protruding portion 21*na* includes a plurality of fuel injection holes 110. Configurations of the fuel injection holes 110 are not specifically limited. A swirl chamber arranged to provide swirl force to the fuel may be provided on the upstream side of the fuel injection holes 110. Central axes 110*a* of the fuel injection holes may be parallel to the central axis 1*x* of the fuel injection valve, and may be inclined. Moreover, the protruding portion 21*na* may be not provided.

The fuel injection portion 21 arranged to determine a shape of the fuel spray is constituted by the nozzle plate 21*n*. The valve seat 15 and the fuel injection portion 21 constitute the nozzle section 8 arranged to inject the fuel. The valve element 27*c* may be considered as a part of components constituting the nozzle section 8.

In this embodiment, the valve element 27*c* is a ball valve having a spherical shape. Accordingly, the valve element 27*c* includes a plurality of cutaway surfaces 27*ca* which are formed at portions confronting the guide surface (the through hole 15*c*), and which are positioned at intervals in the circumferential direction. These cutaway surfaces 27*ca* constitute the fuel passages arranged to supply the fuel to the seat portion. The valve element 27*c* may be constituted by a member other than the ball valve. For example, the valve element 27*c* may be a needle valve.

When the valve seat member 15 is assembled to the tip end portion of the cylindrical member 5, the distortion may be generated in the valve seat 15*b* due to the stress generated by the welding, the press-fit and so on. When the distortion is generated in the valve seat 15*b*, it is not possible to maintain the roundness necessary for the seat portion of the valve seat 15*b*. With this, the sealing characteristic of the seal portion may be deteriorated in the valve closing state.

Accordingly, in this embodiment, there is provided a stress absorbing portion (distortion absorbing portion) arranged to absorb the stress generated at the assembly of the valve seat member 15, and thereby to suppress the distortion generated in the valve seat 15*b*. Moreover, in this embodiment, there is provided a means arranged to suppress a misalignment of the central axis (axis misalignment) of the valve seat member 15 (the valve seat 15*b*). Hereinafter, the stress absorbing portion and the axis misalignment suppressing portion are explained.

Figure 3:
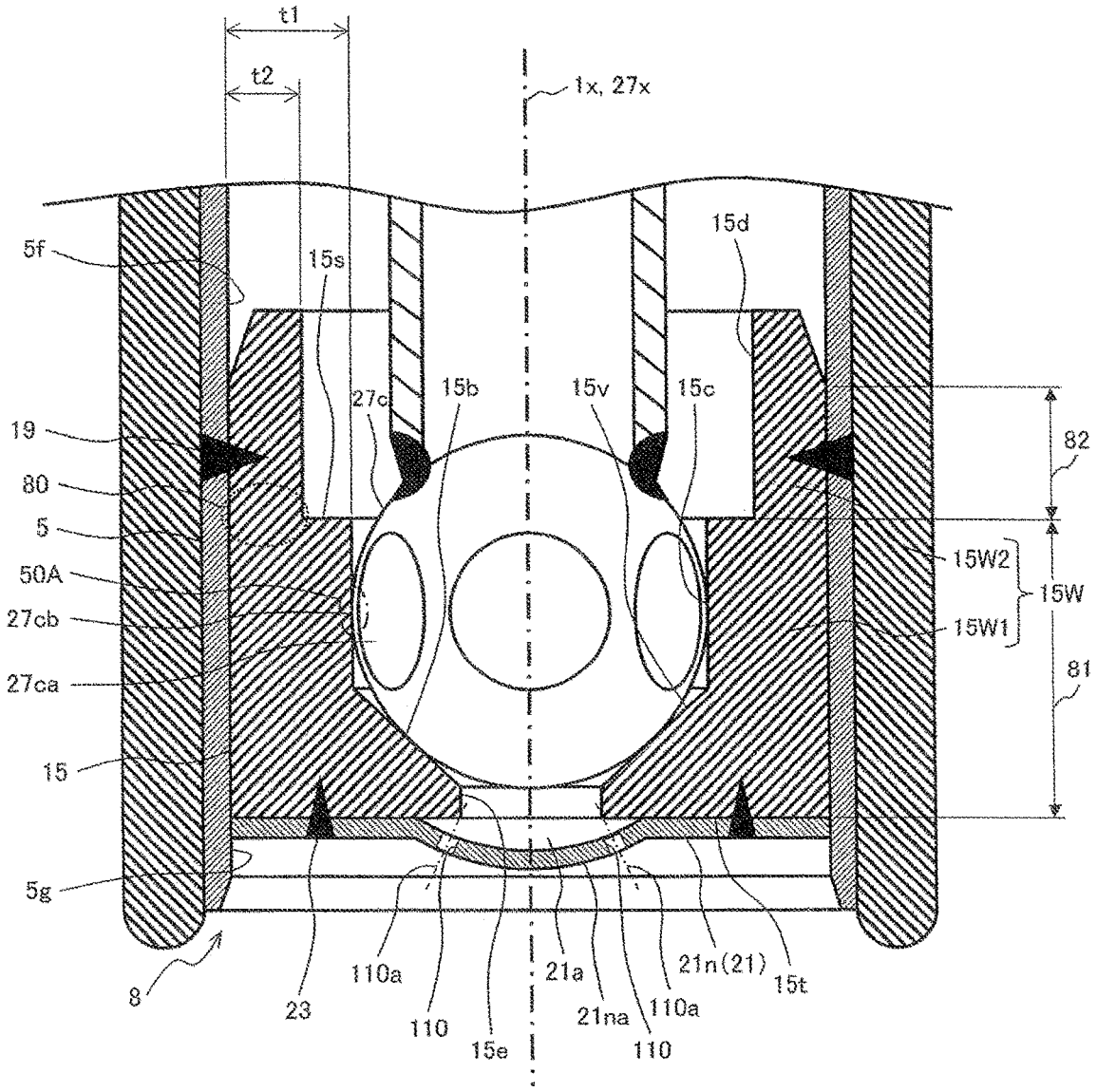
FIG. 3 is an enlarged sectional view showing a portion near a nozzle section 8 shown in FIG. 2.

As shown in FIG. 3, the valve seat member 15 includes the side wall portion 15*w* which is formed on the outer circumference side of the valve seat 15*b*, and which extends upwardly toward the base end side in the direction along the central axes 1*x* and 27*x*. In particular, in the embodiment, the side wall portion 15*w* extends upwardly from a peripheral portion of the inclination surface (the through hole 15*v*) constituting the valve seat 15*b* toward the base end side (the upstream side). The side wall portion 15*w* includes a downstream side wall portion (tip end side wall portion) 15*w*1 which includes an inner circumference surface of the through hole 15*c*, and an upstream side wall portion (base end side wall portion) 15*w*2 which includes an inner circumference surface of the through hole 15*d*.

The inner circumference surface of the downstream side wall portion 15*w*1 is constituted by a cylindrical surface having a uniform diameter from the upper end portion to the lower end portion. Moreover, the upstream side wall portion 15*w*2 is constituted by a cylindrical surface having a uniform diameter from the upper end portion to the lower end portion. An inside diameter (diameter) of the upstream side wall portion 15*w*2 (the through hole 15*d*) is greater than an inside diameter (diameter of the inner circumference surface) of the downstream side wall portion 15*w*1 (through hole 15*c*). A stepped surface 15*s* is formed between the inner circumference surface of the upstream side wall portion 15*w*2 and the inner circumference surface of the downstream side wall portion 15*w*1.

By forming the stepped surface 15*s*, a thickness (radial thickness) of the upstream side wall portion 15*w*2 on the base end side of the stepped surface 15*s* is smaller than a thickness (radial thickness) of the downstream side wall portion 15*w*1 on the tip end side of the stepped surface 15*s*. By forming the stepped surface 15*s*, the small thickness portion 80 is formed in the side wall portion 15*w*.

That is, the side wall portion 15*w* includes the through hole 15*d* which is a base end side hole portion (base end side inner circumference surface) formed to have a uniform inside diameter from the stepped surface 15*s* to the base end side end portion of the valve seat member 15; and the through hole 15*c* which is a tip end side hole portion (tip end side inner circumference surface) formed to have an inside diameter smaller than the inside diameter of the through hole 15*d* from the stepped surface 15*s* toward the tip end side of the valve seat member 15. The stepped surface 15*s* is formed on the inner circumference side of the valve seat member 15 by the difference between the inside diameters of the through hole 15*d* and the through hole 15*c*.

In this embodiment, the valve seat member 15 is press-fit into the inner circumference portions 5*f* and 5*g* of the tip end portion of the cylindrical member 5. Then, the valve seat member 15 and the cylindrical member 5 are fixed by the welding portion 19.

In the press-fit of the valve seat member 15, pressures (hereinafter, referred to as an abutment pressure) acted to the abutment surfaces on which the valve seat member 15 and the cylindrical member 5 are abutted on each other are set to be different in a range 81 and a range 82 in the direction along the central axes 1*x* and 27*x*. In this embodiment, the abutment pressure in the range 81 is set to be smaller than the abutment pressure in the range 82. The ranges 81 and 82 are explained in detail later.

Figure 4:
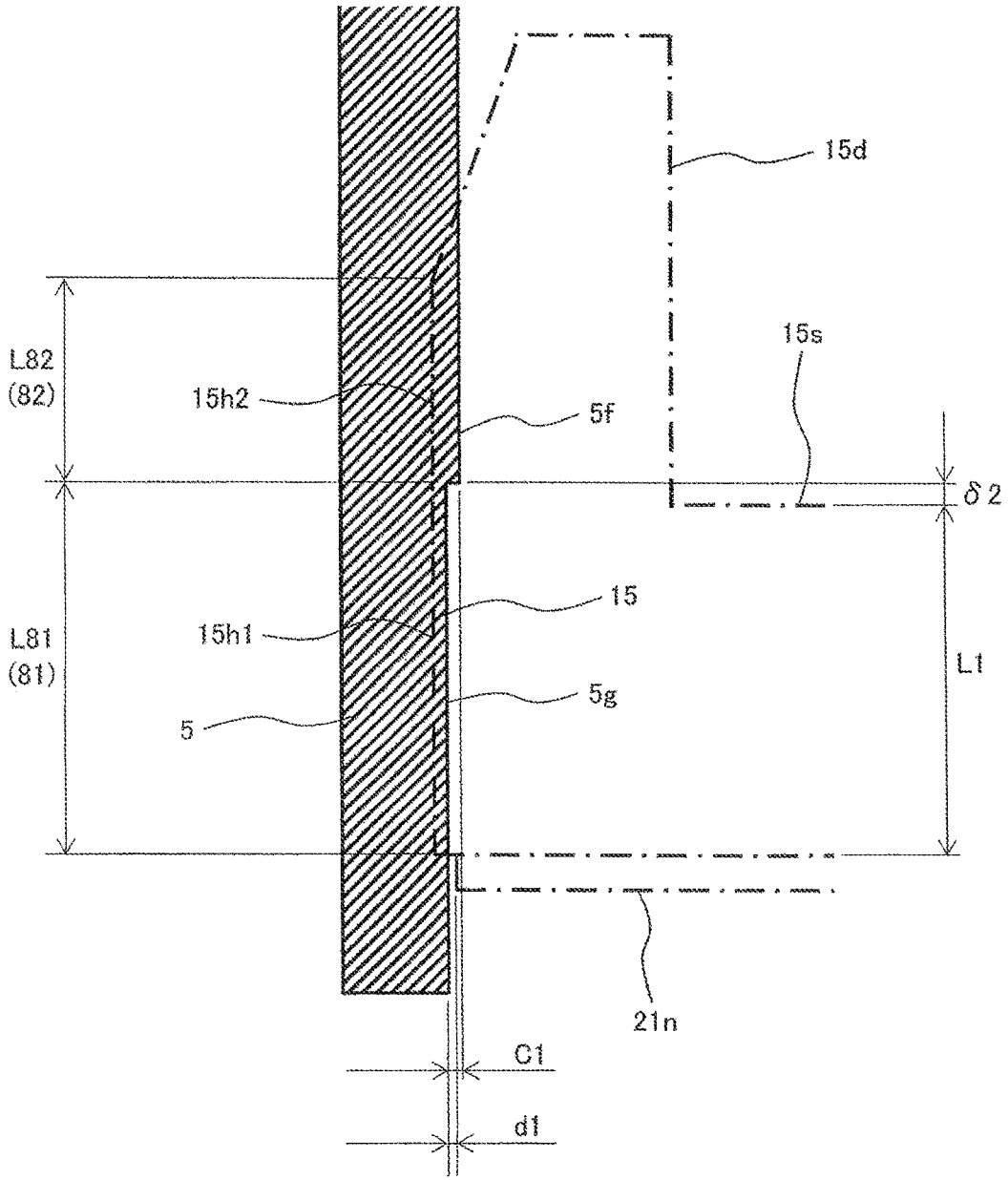
FIG. 4 is a sectional view schematically showing a mounting portion of a valve seat member 15 with respect to a cylindrical member 5.

FIG. 4 is a sectional view schematically showing a configuration of the mounting portion of the valve seat member 15 with respect to the cylindrical member 5. In FIG. 4, a solid line represents the tip end portion of the cylindrical member 5. One dot chain line shows the nozzle plate 21*n* and the valve seat member 15 before the press-fit. In FIG. 4, the nozzle plate 21*n* and the valve seat member 15 before the press-fit are shown to be overlapped at a position at which the valve seat member 15 and the nozzle plate 21*n* are assembled to the cylindrical member 5 after the press-fit.

As shown in FIG. 4, the inner circumference surface portion 5*g* having a large diameter, the inner circumference surface portion 5*f* having a small diameter are formed on the inner circumference side of the cylindrical member 5. The inner circumference surface portion 5*f* is provided on the upstream side (the base end side) of the inner circumference surface portion 5*g* in the direction along the central axes 1*x* and 27*x*. The inner circumference surface portion 5*g* is provided on the downstream side (the tip end side) of the inner circumference surface portion 5*f*. The inside diameter (the diameter) of the inner circumference surface portion 5*f* is smaller than the inside diameter (the diameter) of the inner circumference surface portion 5*g*. That is, a step (level difference) having a height C1 is provided between the inner circumference surface portion 5*f* and the inner circumference portion 5*g*. With this, the radius of the inner circumference surface portion 5*f* is smaller than the radius of the inner circumference surface portion 5*g* by C1. In this embodiment, an outer circumference surface portion 15*h*1 of the valve seat member 15 which is abutted on the inner circumference surface portion 5*g*, and an outer circumference surface portion 15*h*2 which is abutted on the inner circumference surface portion 5*f* have the same outside diameter.

A gap d1 is provided between an outer periphery portion of the nozzle plate 21*n* and the inner circumference surface portion 5*g*, so as to avoid the interference between the outer periphery portion of the nozzle plate 21*n* and the inner circumference surface portion 5*g* when the valve seat member 15 is press-fit in the inner circumference side of the cylindrical member 5.

In a case where the valve seat member 15 is press-fit in the inner circumference side of the cylindrical member 5, the outer circumference surface portion 15*h*1 of the valve seat member 15 which is abutted on the inner circumference surface portion 5*g* of the cylindrical member 5 receives the abutment pressure from the inner circumference surface 5*g*. Moreover, the outer circumference surface portion 15*h*2 of the valve seat member 15 which is abutted on the inner circumference surface portion 5*f* of the cylindrical member 5 receive the abutment pressure from the inner circumference surface portion 5*f*. In this case, the abutment pressure (the abutment pressure in the range 81) received by the outer circumference surface portion 15*h*1 from the inner circumference portion 5*g* is smaller than the abutment pressure (the abutment pressure in the range 82) received by the outer circumference surface portion 15*h*2 from inner circumference surface portion 5*f*.

An upper end portion of the inner circumference surface portion 5*g* (a lower end portion of the inner circumference surface portion 5*f*) is positioned at the same position as the stepped surface 15*s*, or above the stepped surface 15*s* in the direction along the central axes 1*x* and 27*x*. It is more preferable that the upper end portion of the inner circumference surface portion 5*g* is positioned above the stepped surface 15*s*. In this embodiment, a gap δ2 is provided between the upper end portion of the inner circumference surface portion 5*g* and the stepped surface 15*s* in the direction along the central axes 1*x* and 27*x*. Accordingly, a length L81 from the lower end of the valve seat member 15 to a boundary between the inner circumference surface portion 5*f* and the inner circumference surface portion 5*g* of the cylindrical member 5 is longer than the length L1 from the lower end of the valve seat member 15 to the stepped surface 15*s*. The length L81 is a length of the above-described range 81. A length L82 shown in FIG. 4 is a length of the above-described range 82.

With this, the lower end portion of the outer circumference surface portion 15*h*2 which receives the large abutment pressure from the inner circumference surface portion 5*f* is positioned above the small thickness portion 80. The small thickness portion 80 is constituted between the outer circumference surface portion 15*h*2 on which the large abutment pressure is generated, and the abutment portion (the seal portion) between the valve element 27*c* and the valve seat 15*b*.

The distortion is easy to be generated in the outer circumference surface portion 15*h*2 on which the large abutment pressure is generated. However, even when the distortion is generated in the outer circumference surface portion 15*h*2, it is possible to absorb this distortion by the space (that is, the small thickness portion 80) formed radially inside the small thickness portion 80, by constituting the small thickness portion 80. The small thickness portion 80 constitutes a distortion absorbing space arranged to absorb the distortion generated in the valve seat member 15.

That is, the large stress is generated in the portion near the outer circumference surface portion 15*h*2 of the valve seat member 15 due to the generation of the distortion. However, it is possible to absorb the influence by this stress, by the space formed radially inside the small thickness portion 80, so as not to exert this influence by the stress on the abutment portion (the seal portion) between the valve element 27*c* and the valve seat 15*b*. That is, by providing the small thickness portion 80, it is possible to prevent the decrease of the roundness of the valve seat 15*b* due to the distortion and the stress by the press-fit, and to suppress the decrease of the oil tightness of the seal portion.

On the other hand, in the outer circumference surface portion 15*h*1 of the valve seat member 15, the abutment pressure with the inner circumference surface portion 5*g* of the cylindrical member 5 is small. Accordingly, it is possible to suppress the distortion and the stress which are generated in the downstream side wall portion 15*w*1 and the valve seat 15*b*.

With this, it is possible to suppress the deteriorations of the size accuracy and the roundness of the valve seat 15*b*, and to suppress the deterioration of the oil tightness of the seal portion at which the valve element and the valve seat are abutted on each other.

Moreover, the outer circumference surface portion 15*h*1 of the valve seat member 15 is abutted on the inner circumference surface portion 5*g* of the cylindrical member 5. Accordingly, the outer circumference surface portion 15*h*1 is held by the inner circumference surface portion 5*g* of the cylindrical member 5 from the radially outer side, so that the radial displacement of the outer circumference surface portion 15*h*1 is suppressed. With this, it is possible to suppress the radial displacement of the central axis of the valve seat 15*b*. Consequently, it is possible to suppress the deterioration of the concentricity (coaxiality) of the valve seat 15*b*, and to suppress the inclination of the movable member 27 with respect to the central axes 1*x* and 27*x*. Therefore, it is possible to suppress the decrease of the oil tightness of the seal portion.

The welding of the welding portion 19 is performed by irradiating the laser to the outer circumference surface of the cylindrical member 5 from the outside of the cylindrical member 5. The welding portion 19 is provided to the entire circumferences of the cylindrical member 5 and the valve seat member 15. In this embodiment, the welding portion 19 is provided to the upstream side wall portion 15*w*2 above the stepped surface 15*s* (on the base end side of the stepped surface 15*s*). With this, it is possible to constitute the small thickness portion 80 between the welding portion 19 in which the distortion and the stress are generated by the welding heat, and the abutment portion (the seal portion) between the valve element 27*c* and the valve seat 15*b*. With this, even when the distortion is generated in the portion of the valve seat member 15 near the welding portion 19 due to the welding heat, it is possible to absorb this distortion by the space formed radially inside the small thickness portion 80.

That is, the large stress is generated in the portion of the valve seat member 15 near the welding portion 19 due to the generation of the distortion. However, it is possible to release the influence due to this stress to the space formed radially inside the small thickness portion 80, so as not to exert the influence due to this stress to the abutment portion (the seal portion) between the valve element 27*c* and the valve seat 15*b*. That is, by providing the small thickness portion 80, it is possible to prevent the deterioration of the roundness of the valve seat 15*b* due to the distortion and the stress by the welding heat, and to suppress the deterioration of the oil tightness at the seal portion.

Besides, the small thickness portion 80 needs not to be provided to the entire area of the upstream side wall portion 15*w*2 in the direction along the central axes 1*x* and 27*x*. The small thickness portion 80 needs to be provided below the welding portion 19 (on the tip end side of the welding portion 19).

Moreover, the outside diameter of the outer circumference surface portion (the tip end side outer circumference surface portion) 15*h*1 of the valve seat member 15 may be smaller than the outside diameter of the outer circumference surface portion (the base end side outer circumference surface portion) 15*h*2, in place of providing the inner circumference surface portion 5*g* having the large diameter, and the inner circumference surface portion 5*f* having the small diameter, on the inner circumference side of the cylindrical member 5. In this case, it is possible to set the inner circumference surface portion 5*f* and the inner circumference surface portion 5*g* of the cylindrical member 5 to have the same inside diameter. In this case, it is possible to set the above-described gap δ2 on the valve seat member 15, and thereby to ease the setting of the gap δ2.

The inside diameter of the inner circumference surface of the cylindrical member 5, and the outside diameter of the outer circumference surface of the valve seat member 15 may have configurations other than the above-described configuration as long as the inner circumference surface of the cylindrical member 5, and the outer circumference surface of the valve seat member 15 are provided so that the abutment pressures satisfy the above-described relationship. That is, the outside diameter of the outer circumference surface portion 15*h*1 which is the tip end side outer circumference surface portion of the valve seat member 15, the outside diameter of the outer circumference surface portion 15*h*2 which is the base end side outer circumference surface portion of the valve seat member 15, the inside diameter of the inner circumference surface portion 5*g* on the tip end side of the cylindrical member 5, and the inside diameter of the inner circumference surface portion 5*f* on the base end side of the cylindrical member 5 are not limited to the above-described configuration as long as the abutment pressure on the tip end side of the stepped surface 15*s* is smaller than the abutment pressure on the base end side of the stepped surface 15*s*.

Next, small thickness portions 80 according to variations are explained.

Figure 5:
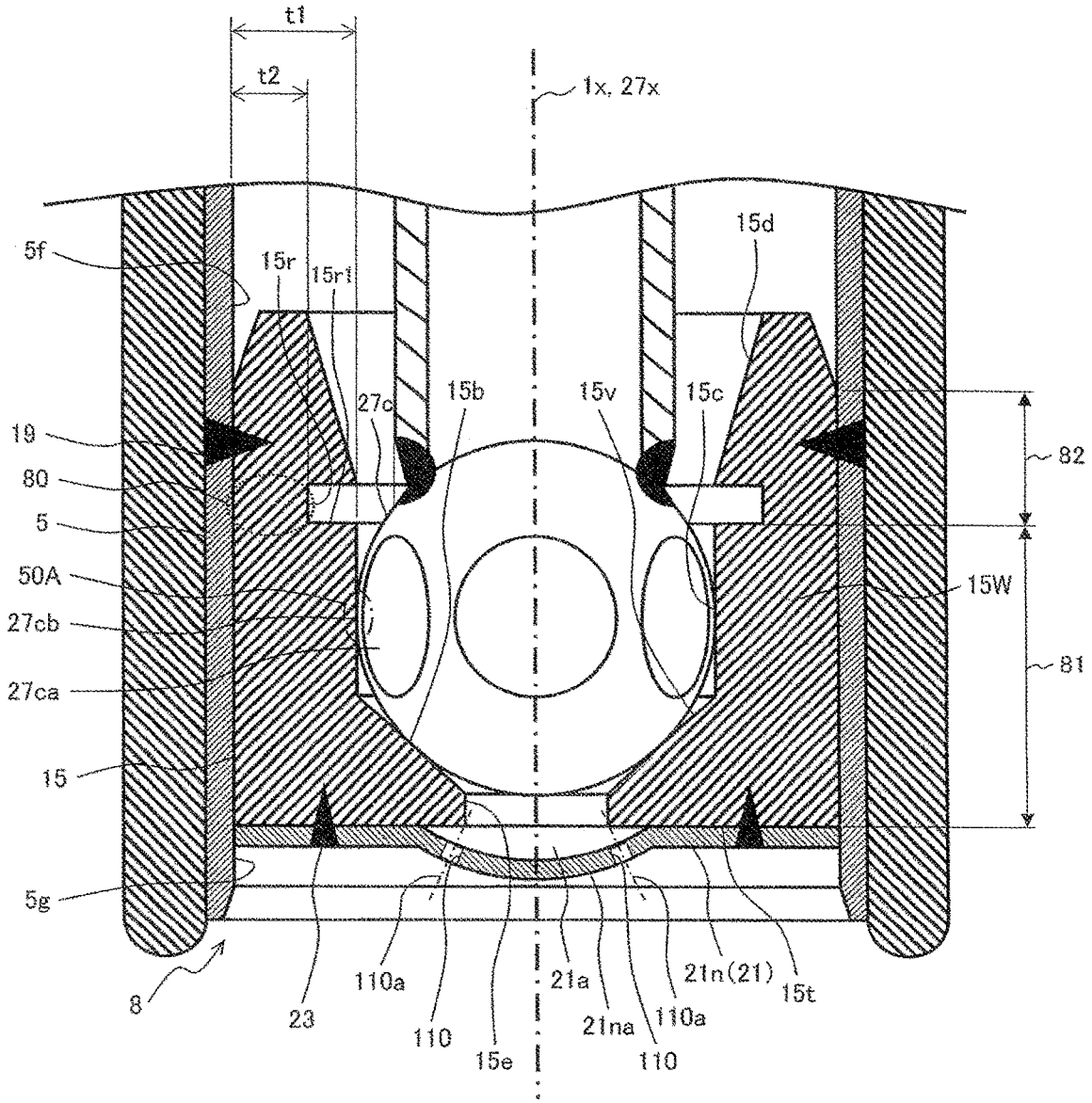
FIG. 5 is an enlarged sectional view of a nozzle section 8, showing a small thickness portion 80 according to a first variation.

FIG. 5 is an enlarged sectional view of the nozzle section 8, showing a small thickness portion 80 according to a first variation.

In this variation, the small thickness portion 80 is constituted by an annular groove 15*r* formed on the inner circumference surface of the valve seat member 15. The annular groove 15*r* is formed in the entire circumference of the inner circumference surface of the valve seat member 15. The small thickness portion 80 is formed radially outside the valve seat member 15 with respect to the annular groove 15*r*. The other configurations are identical to those of the above-described embodiment.

A lower side surface 15*r*1 of the annular groove 15*r* corresponds to the above-described stepped surface 15*s*. The above-described ranges 81 and 82, the inner circumference surface portions 5*f* and 5*g* of the cylindrical member 5, the outer circumference surface portions 15*h*1 and 15*h*2 of the valve seat member 15, and the sizes L1, L81, L82, and δ2 of the various portions are constituted to be identical to those of the above-described configuration, by using the lower side surface 15*r*1 of the annular groove 15*r* in place of the stepped surface 15*s*.

Figure 6:
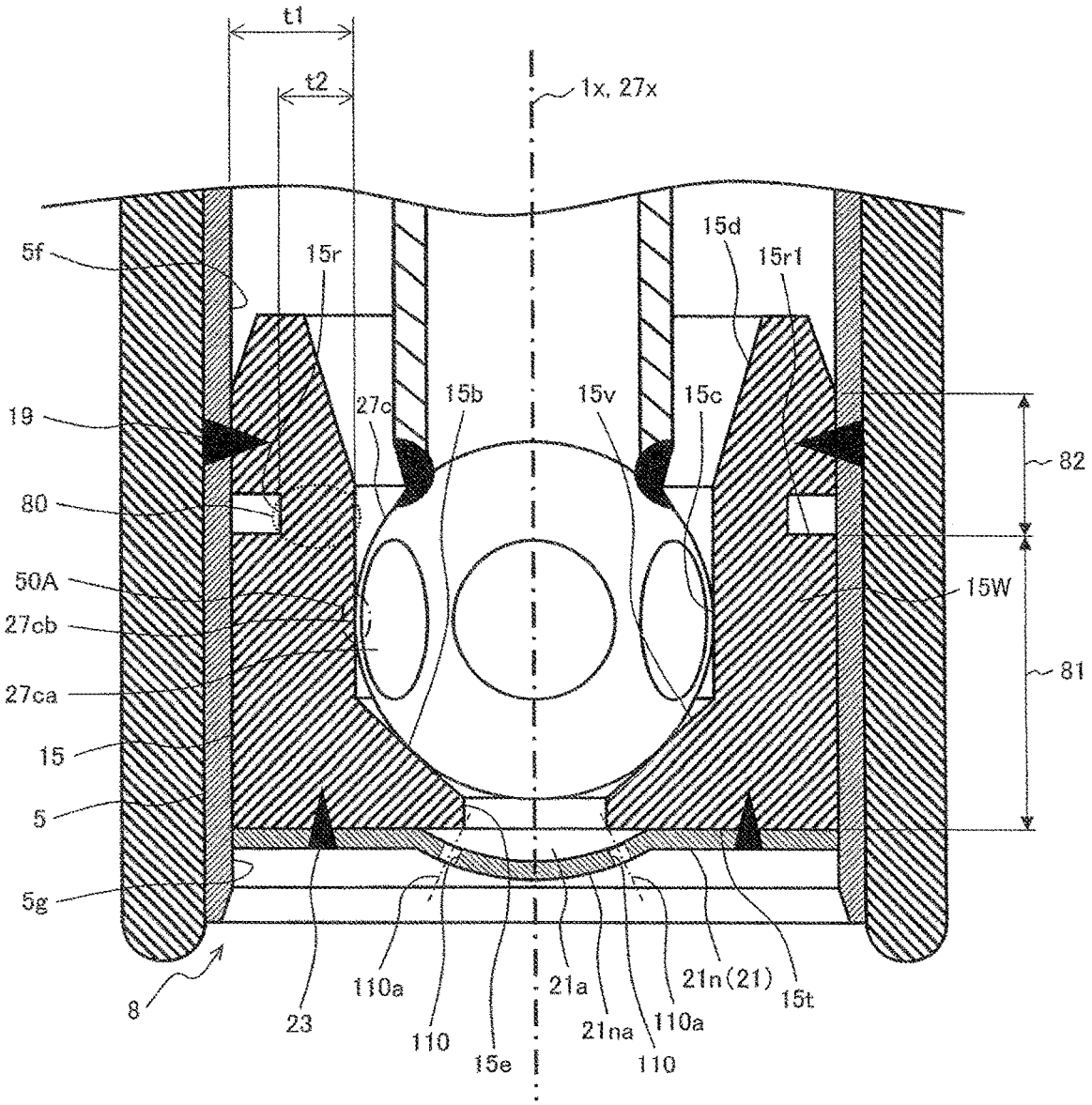
FIG. 6 is an enlarged sectional view of a nozzle section 8, showing a small thickness portion 80 according to a section variation.

FIG. 6 is an enlarged sectional view of the nozzle section 8, showing a small thickness portion 80 according to a second variation.

In this variation, the small thickness portion 80 is constituted by the annular groove 15*r* formed on the outer circumference surface of the valve seat member 15. The annular groove 15*r* is formed in the entire circumference of the outer circumference surface of the valve seat member 15. The small thickness portion 80 is formed radially inside the valve seat member 15 with respect to the annular groove 15*r*. The other configurations are identical to those of the above-described embodiment and the first variation.

In this variation, the lower side surface 15*r*1 of the annular groove 15*r* corresponds to the above-described stepped surface 15*s*. The above-described ranges 81 and 82, the inner circumference surface portions 5*f* and 5*g* of the cylindrical member 5, the outer circumference surface portions 15*h*1 and 15*h*2 of the valve seat member 15, and the sizes L1, L81, L82, and δ2 of the various portions are constituted to be identical to those of the above-described configuration, by using the lower side surface 15*r*1 of the annular groove 15*r* in place of the stepped surface 15*s*.

In the embodiment (including the variations) according to the present invention, the small thickness portion 80 is provided in the portion of the valve seat member 15 above the valve seat 15*b*. With this, it is possible to suppress the distortion of the valve seat 15*b*. Moreover, the outer circumference surface portion 15*h*1 (the lower side valve seat member portion) of the valve seat member 15 below the small thickness portion 80 is abutted on the inner circumference surface of the cylindrical member so that the abutment pressure between the cylindrical member 5 and the lower side valve seat member portion 15*h*1 is lower than the abutment pressure between the cylindrical member 5 and the portion (the outer circumference surface portion which is the upper side valve seat member portion) 15*h*2 of the valve seat member 15 above the small thickness portion 80. With this, it is possible to suppress the misalignment of the central axis of the valve seat 15*b*.

Figure 7:
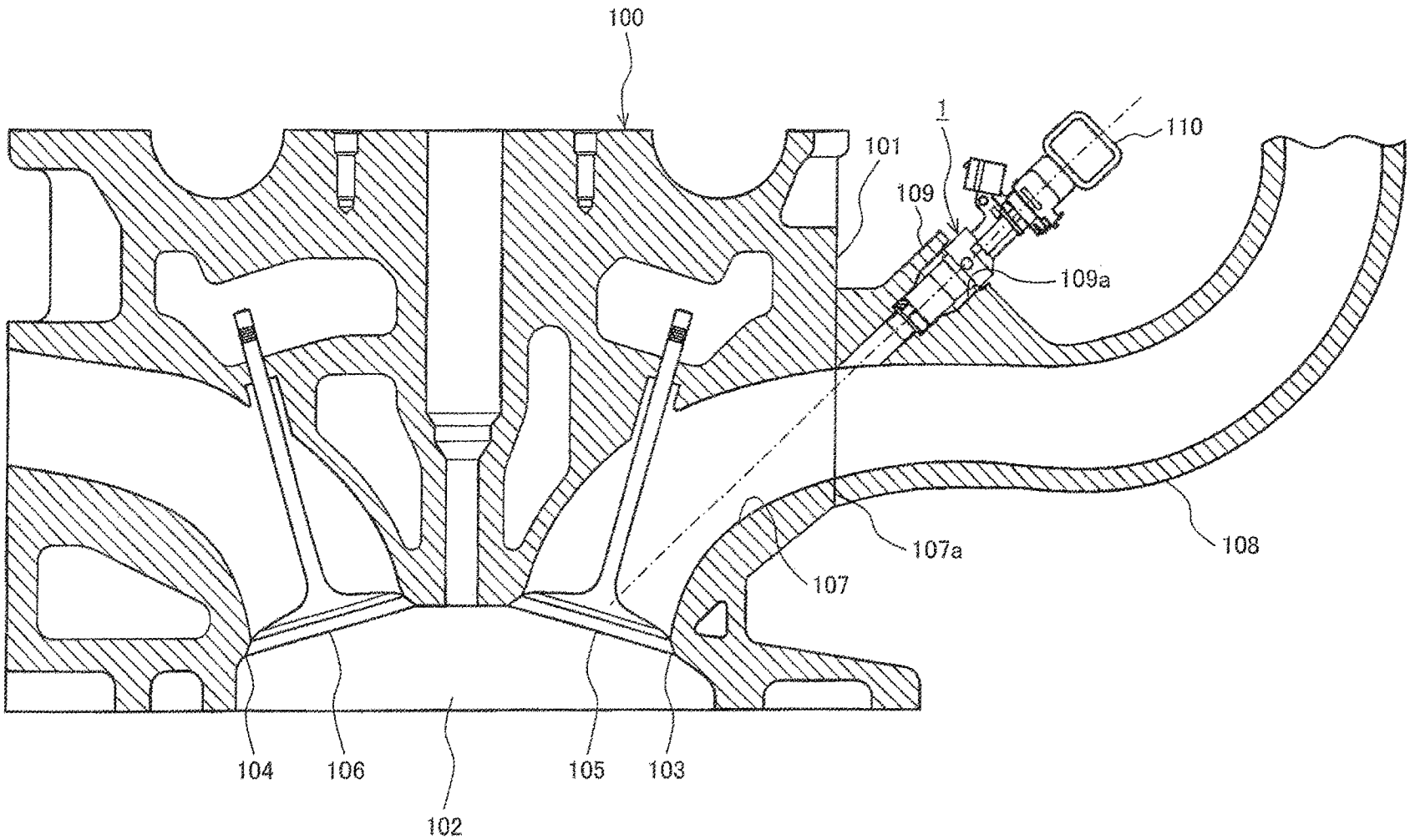
FIG. 7 is a sectional view showing an internal combustion engine to which the fuel injection valve 1 is mounted.

The internal combustion engine to which the fuel injection valve according to the present invention is mounted is explained with reference to FIG. 7. FIG. 7 is a sectional view of the internal combustion engine to which the fuel injection valve 1 is mounted.

An engine block 101 of the internal combustion engine 100 includes a cylinder 102. An intake opening 103 and an exhaust opening 104 are provided on a top portion of the cylinder 102. An intake valve 105 arranged to open and close the intake opening 103 is provided to the intake opening 103. An exhaust valve 106 arranged to open and close the exhaust opening 104 is provided to the exhaust opening 104. The engine block 101 includes an intake flow passage 107 connected to the intake opening 103. The intake flow passage 107 includes an inlet side end portion 107*a* connected to an intake pipe 108.

A fuel pipe is connected to the fuel supply opening 2 (cf. FIG. 1) of the fuel injection valve 1.

The intake pipe 108 includes a mounting portion 109 for the fuel injection valve 1. The mounting portion 109 includes an insertion opening 109*a* to which the fuel injection valve 1 is inserted. The insertion opening 109*a* penetrates to an inner wall surface (intake flow passage) of the intake pipe 108. The fuel injected from the fuel injection valve 1 inserted into the insertion opening 109*a* is injected into the intake flow passage. In case of two directional spray, in the internal combustion engine in which two intake openings 103 are provided to the engine block 101, the respective fuel sprays are directed and injected to the respective intake openings 103 (the intake valves 105).

Besides, the present invention is not limited to the above described embodiment. It is optional to delete a part of the configuration, and to add other configuration which is not described.

For example, below-described aspects are conceivable as the fuel injection valves based on the above-described embodiment.

A fuel injection valve according to one aspect includes: a valve element and a valve seat which are cooperated to open and close a fuel passage; a valve seat member to which the valve seat is formed; a cylindrical member including an end portion which is on a tip end side, and to which the valve seat member is assembled by press-fit and welding; and the valve seat member including a side wall portion which is formed on an outer circumference side of the valve seat, and which extends toward a base end side, the side wall portion including a stepped surface positioned between an end portion on the tip end side, and an end portion on the base end side, a welding portion between the valve seat member and the cylindrical member, which is provided on the base end side of the stepped surface, the valve seat member being assembled to be press-fit in the cylindrical member so that a tip end side abutment pressure between an inner circumference surface of the cylindrical member, and a tip end side outer circumference surface portion of the valve seat member which is on the tip end side of the stepped surface is smaller than a base end side abutment pressure between the inner circumference surface of the cylindrical member, and a base end side outer circumference surface portion of the valve seat member which is on the base end side of the stepped surface portion.

In a fuel injection valve according to a preferable aspect, an outside diameter of the tip end side outer circumference surface portion of the valve seat member, an outside diameter of the base end side outer circumference surface portion of the valve seat member, an inside diameter of a tip end side inner circumference surface portion of the cylindrical member which is formed at a portion abutted on the tip end side outer circumference surface portion, and an inside diameter of a base end side inner circumference surface portion of the cylindrical member which is formed at a portion abutted on the base end side outer circumference surface portion are set so that the tip end side abutment pressure is smaller than the base end side abutment pressure.

In another preferable aspect, the tip end side inner circumference surface portion of the cylindrical member has an inside diameter larger than an inside diameter of the base end side inner circumference surface portion so that the tip end side abutment pressure is smaller than the base end side abutment pressure.

In another preferable aspect, the tip end side outer circumference surface portion of the valve seat member has an outside diameter smaller than an outside diameter of the base end side outer circumference surface portion so that the tip end side abutment pressure is smaller than the base end side abutment pressure.

In another preferable aspect, the side wall portion includes a base end side hole portion having an identical inside diameter from the stepped surface to a base end side end portion of the valve seat member, and a tip end side hole portion having a diameter smaller than the inside diameter of the base end side hole portion from the stepped surface toward the tip end side of the valve seat member; and the stepped surface is formed on an inner circumference side of the valve seat member by a difference between the inside diameters of the base end side hole portion and the tip end side hole portion.

In another preferable aspect, the stepped surface is formed by a side surface portion of an annular groove formed on the inner circumference side of the valve seat member in a radially outward direction.

In another preferable aspect, the stepped surface is formed by a side surface portion of an annular groove formed on the outer circumference side of the valve seat member in a radially inward direction.

The invention claimed is:

1. A fuel injection valve comprising:

a valve element and a valve seat which are cooperated to open and close a fuel passage;

a valve seat member to which the valve seat is formed;

a cylindrical member including an end portion which is on a tip end side, and to which the valve seat member is assembled by press-fit and welding; and the valve seat member including a side wall portion which is formed on an outer circumference side of the valve seat, and which extends toward a base end side, the side wall portion including a stepped surface positioned between an end portion on the tip end side, and an end portion on the base end side, a welding portion between the valve seat member and the cylindrical member, which is provided on the base end side of the stepped surface, the valve seat member being assembled to be press-fit in the cylindrical member so that a tip end side abutment pressure between an inner circumference surface of the cylindrical member, and a tip end side outer circumference surface portion of the valve seat member which is on the tip end side of the stepped surface is smaller than a base end side abutment pressure between the inner circumference surface of the cylindrical member, and a base end side outer circumference surface portion of the valve seat member which is on the base end side of the stepped surface portion.

2. The fuel injection valve as claimed in claim 1, wherein an outside diameter of the tip end side outer circumference surface portion of the valve seat member, an outside diameter of the base end side outer circumference surface portion of the valve seat member, an inside diameter of a tip end side inner circumference surface portion of the cylindrical member which is formed at a portion abutted on the tip end side outer circumference surface portion, and an inside diameter of a base end side inner circumference surface portion of the cylindrical member which is formed at a portion abutted on the base end side outer circumference surface portion are set so that the tip end side abutment pressure is smaller than the base end side abutment pressure.

3. The fuel injection valve as claimed in claim 2, wherein the tip end side inner circumference surface portion of the cylindrical member has an inside diameter larger than an inside diameter of the base end side inner circumference surface portion so that the tip end side abutment pressure is smaller than the base end side abutment pressure.

4. The fuel injection valve as claimed in claim 2, wherein the tip end side outer circumference surface portion of the valve seat member has an outside diameter smaller than an outside diameter of the base end side outer circumference surface portion so that the tip end side abutment pressure is smaller than the base end side abutment pressure.

5. The fuel injection valve as claimed in claim 2, wherein the side wall portion includes a base end side hole portion having an identical inside diameter from the stepped surface to a base end side end portion of the valve seat member, and a tip end side hole portion having a diameter smaller than the inside diameter of the base end side hole portion from the stepped surface toward the tip end side of the valve seat member; and the stepped surface is formed on an inner circumference side of the valve seat member by a difference between the inside diameters of the base end side hole portion and the tip end side hole portion.

6. The fuel injection valve as claimed in claim 2, wherein the stepped surface is formed by a side surface portion of an annular groove formed on the inner circumference side of the valve seat member in a radially outward direction.

7. The fuel injection valve as claimed in claim 2, wherein the stepped surface is formed by a side surface portion of an annular groove formed on the outer circumference side of the valve seat member in a radially inward direction.

* * * * *